United States Patent [19]

Lunt

[11] Patent Number: 4,538,570

[45] Date of Patent: Sep. 3, 1985

[54] FLUID VALVE

[75] Inventor: Martin R. Lunt, Brentwood, England

[73] Assignee: Ford Motor Company, Dearborn, Mich.

[21] Appl. No.: 594,520

[22] Filed: Mar. 29, 1984

[30] Foreign Application Priority Data

May 31, 1983 [GB] United Kingdom ..... 8314988

[51] Int. Cl.[3] ..... F02M 9/10

[52] U.S. Cl. ..... 123/337; 123/198 D; 261/44 H; 261/DIG. 56

[58] Field of Search ..... 123/337, 585, 198 D; 261/44 H, 65, DIG. 56

[56] References Cited

U.S. PATENT DOCUMENTS

| | | | |
|---|---|---|---|
| 977,044 | 11/1910 | Rebourg | 261/44 |
| 1,202,025 | 10/1916 | Buffum | 261/44 H |
| 2,026,916 | 1/1936 | Smith | 251/5 |
| 2,898,088 | 8/1959 | Alder | 237/5 |
| 3,123,060 | 3/1964 | Daigh | 123/572 |
| 3,237,616 | 3/1966 | Daigh et al. | 137/480 |
| 3,570,824 | 3/1971 | Strohm et al. | 261/44 H |
| 4,096,211 | 7/1978 | Rameau | 261/23 A |
| 4,135,550 | 1/1979 | Anderson | 137/565 |
| 4,195,810 | 4/1980 | Lavin | 251/5 |
| 4,310,140 | 1/1982 | Boomer et al. | 251/5 |

FOREIGN PATENT DOCUMENTS

| | | |
|---|---|---|
| 405351 | 2/1934 | United Kingdom . |
| 710532 | 6/1954 | United Kingdom . |

*Primary Examiner*—William A. Cuchlinski, Jr.
*Attorney, Agent, or Firm*—Clifford L. Sadler; Robert E. McCollum

[57] ABSTRACT

The invention relates to a fluid valve, in particular for use as a throttle valve in an internal combustion engine. The valve has a flow path (25) for the air (26) defined by a tube having a flexible wall (14) which separates the tube from an adjacent chamber (36), so that a change in the pressure within the chamber (36) deforms the flexible wall (14) and thus causes a change in the internal cross-section of the passage (25). When the valve is in its closed position, air can still flow through an air bypass passage (46).

10 Claims, 3 Drawing Figures

FLUID VALVE

The present invention relates to a valve for fluids, more particularly, for air or fuel/air mixtures in combustion engines.

The conventional throttle valve, such as is found in a vehicle carburettor, employs a "butterfly" plate cooperating with a valve seat to vary the dimensions of a through-passage as the throttle plate turns relative to the valve seat.

One disadvantage of a butterfly valve is that the control of throughput is not accurate enough to ensure the most economic use of fuel. Another disadvantage is that it is difficult to control the opening of a butterfly valve, and therefore the air flow through the valve, in response to an electrical signal from an electronic engine management system.

The present invention seeks to provide a valve which may be used as a throttle valve in an internal combustion engine, to afford greater control over the air intake than can be achieved by means of a butterfly valve.

According to the present invention, there is provided a throttle valve for use in a motor vehicle in which a fluid flow path having a core positioned centrally therein is defined by a tube having a flexible wall which separates the flow path from an adjacent working fluid chamber, whereby changes in the pressure within the chamber cause deformation of the flexible wall resulting in changes in the tube cross-section between a wide open throttle position and a valve closed position, characterised in that the flexible wall takes up a valve closed position when the pressures on opposite sides of the wall are equal.

By employing a flexible-walled tube as a valve to control the flow of a fluid, it is possible to control the throughput with greater accuracy. Furthermore, the through passage of the tube is not constricted by an asymmetrical valve closure member, such as the butterfly valve of a conventional carburettor, and may therefore operate with an increased through flow for a given internal cross-section, and with reduced turbulence under given flow conditions.

In a motor vehicle engine, a throttle valve is provided to throttle the intake of air or of an air/fuel mixture into the engine. During normal operation, although the throttle valve is closed, this intake is not normally shut off completely, although under some engine management proposals it may possibly be desirable to shut off the intake completely. When the engine is idling, air is still normally reaching the engine through an idle passage. This idle passage may be through the valve, or may be external of the valve. References in this specification to a "valve closed" position should therefore be read accordingly, i.e. in the "valve closed" position, the valve may still provide for an idle passage through the valve.

The core may have a through passage which remains open when the flexible wall seals against the core, to define a minimum fluid flow or idle passage, from one side of the valve to the other.

Alternatively, when the flexible wall seals against the core in the valve closed position, minimum fluid flow may be provided through an external passage which extends from one side of the valve to the other.

The external passage may communicate with the working fluid chamber so that the chamber can be connected to the fluid pressure on either side of the valve, and the passage may include a control valve for controlling flow through the passage.

The control valve may be positioned in the external passage between the chamber and the downstream end of the through flow passage.

There may be a second control valve positioned in the bypass passage, between the chamber and the upstream end of the through flow passage.

The first control valve can be normally open, and the second control valve can be normally closed.

In a further alternative method of establishing a minimum through flow condition, closure control means are provided, for controlling the movement of the flexible wall in a valve closing direction, the control means being adapted to limit the wall movement at a predetermined position before the wall seals against the valve core, so that a minimum fluid flow is possible from one side of the valve to the other, between the core and the flexible wall.

It would be possible for the control means to be overridden to close the valve completely.

An external passage may extend from one side of the valve to the other to communicate with the working fluid chamber, and a change-over control valve may be provided at the point where the external passage communicates with the chamber, the control valve having a first position where it allows communication between the chamber and the downstream side of the valve and a second position where it allows communication between the chamber and the upstream side of the valve.

The change-over control valve can be biassed into its second position.

It may be desirable to modulate the setting of the change-over control valve to control the pressure in the chamber.

The invention also provides an internal combustion engine having a throttle valve for controlling the air intake, the valve being as set forth above, and the upstream side of the valve being connected to an air intake through an air filter and the downstream side being connected to the engine intake manifold vacuum.

The working fluid chamber may be connected to engine manifold vacuum.

The invention will be further described, by way of example, with reference to the accompanying drawings, in which.

Figure 1:
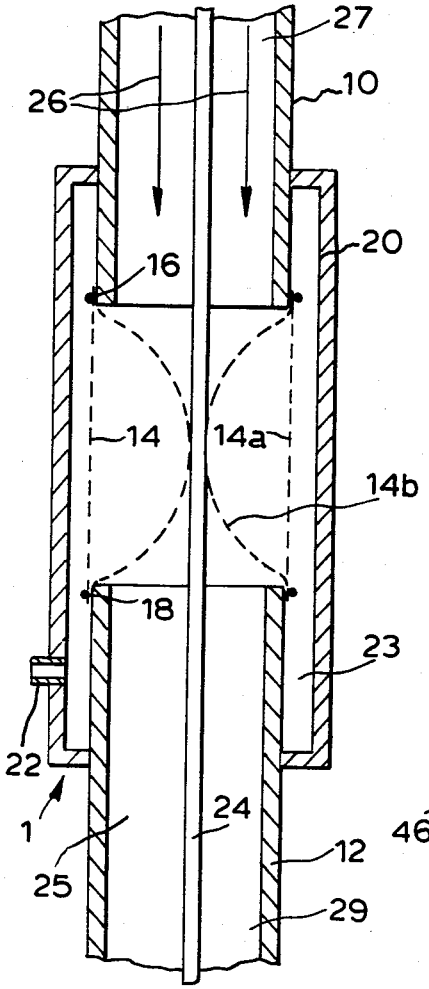
FIG. 1 is a schematic representation of a first form of valve according to the present invention.

The valve 1 shown in FIG. 1 comprises an inlet pipe 10 and an outlet pipe 12 fitting in a fluid tight manner in a housing 20. A flexible tube 14 is joined by means of seals 16 and 18 in a fluid tight manner, to the pipes 10 and 12 respectively. The flexible tube divides the housing interior into a fluid through flow passage 25 and a surrounding working fluid chamber 23 having a control port 22.

A narrow tube 24 passes centrally down the through flow passage 25 from an upstream end 27 to a downstream end 29 and provides a by-pass line to supply a small amount of air such as is required for engine idling.

In operation, the hydraulic or pneumatic pressure within the chamber 23 is changed by admission or removal of a working fluid through the port 22. This causes a deformation of the flexible walled tube 14 between limit positions 14*a* and 14*b*, shown in dotted lines. In this way, the internal through flow cross-section of the passage 25 changes, enabling control of the fluid flow indicated by arrows 26.

The flexible tube 14 in its rest condition adopts the position 14*b* and is deformed to open the passage 25 by removal of the working fluid from the control chamber. The return to the rest position may rely exclusively on the elasticity of the tube 14, or it may be assisted by admission of the working fluid under positive pressure.

The tube 14 is an elastic tube which, when relaxed, has a constant cross-section of dimension substantially equal to its centre part in the position 14*b*. To fit the tube, its ends are stretched to fit over the inlet and outlet pipes 10 and 12.

A result of this configuration is that the valve fails "safe", i.e. if the working fluid supply or he electrical control signal is interrupted, the valve will automatically close, and stop fuel flow.

Suitable materials for the tube 14 are elastomers such as neoprene, nitrile rubber, fluoro-silicone and epichlorohydrin.

Figure 2:
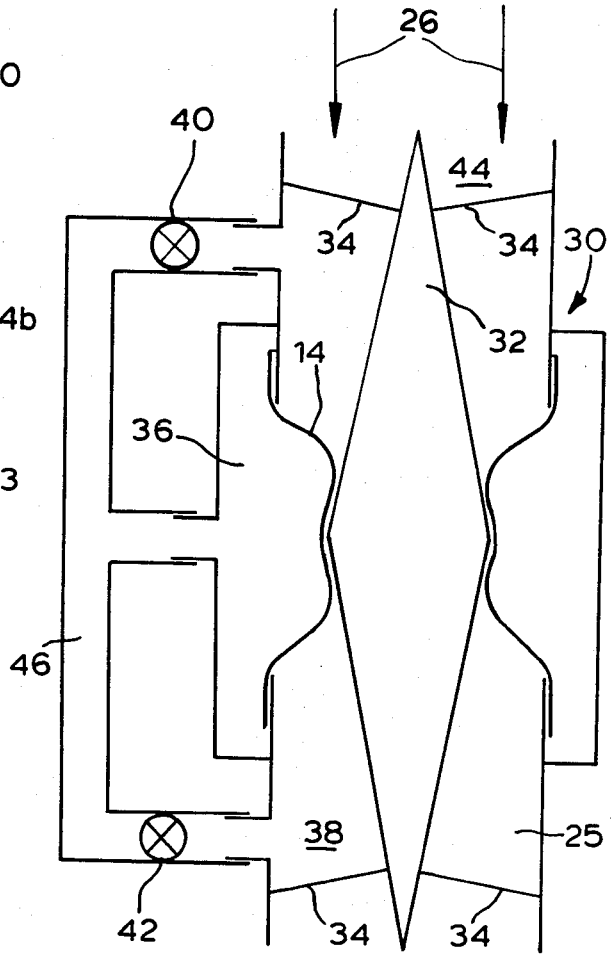
FIG. 2 is a schematic representation of a second form of valve according to the present invention.

The valve 30 shown in FIG. 2 is similar to that shown in FIG. 1, but includes a solid body or core 32 mounted concentrically in the through flow passage 25. This body is supported by retaining wires 34. The body 32 may have a double cone shape as shown and helps to provide a good seal when the tube 14 extends inwardly. The body will be shaped in accordance with aerodynamic considerations to provide a low resistance to flow, and to this end the vertices of the body shown in the drawing may all be rounded. The greatest diameter of the body should be just sufficient to provide a good seal when the tube extends inwardly.

To control this valve, pneumatic force is used, derived from the vehicle manifold vacuum. The rest position of the flexible tube 14 is shown in FIG. 2 where the valve is closed. To open the valve, a negative pressure is applied to the chamber 36. This negative pressure is derived from the vacuum created by the engine on the manifold side 38 of the valve. To apply this pressure to the chamber 36, a normally open control valve 40 is closed and a normally closed control valve 42 is opened.

To close the valve, the negative pressure in chamber 36 has to be released. This is done by closing the control valve 42 and opening the control valve 40. The pressure in the chamber 36 can then reach equilibrium with the pressure on the air filter side 44 of the valve.

The control valves 40 and 42 can be operated by electrical solenoids which can be controlled by electronic logic or can be incorporated in an electronic engine control system or in a cruise control system.

The flow required to support idling can take place through the pneumatic circuit 46, whilst the tube 14 closes the valve. To control the idling flow rate, the normally open control valve 40 will remain unoperated and thus open. The flow through the circuit 46 will thus be entirely through the control valve 42, the opening of which can be accurately controlled.

It is possible to eliminate the control valve 42 and to control the main valve using the control valve 40 only. This has an advantage of reduced complexity.

The control valve 40 (and the control valve 42, if used) can be a simple ON/OFF pulse width modulated or proportional solenoid valve.

Figure 3:
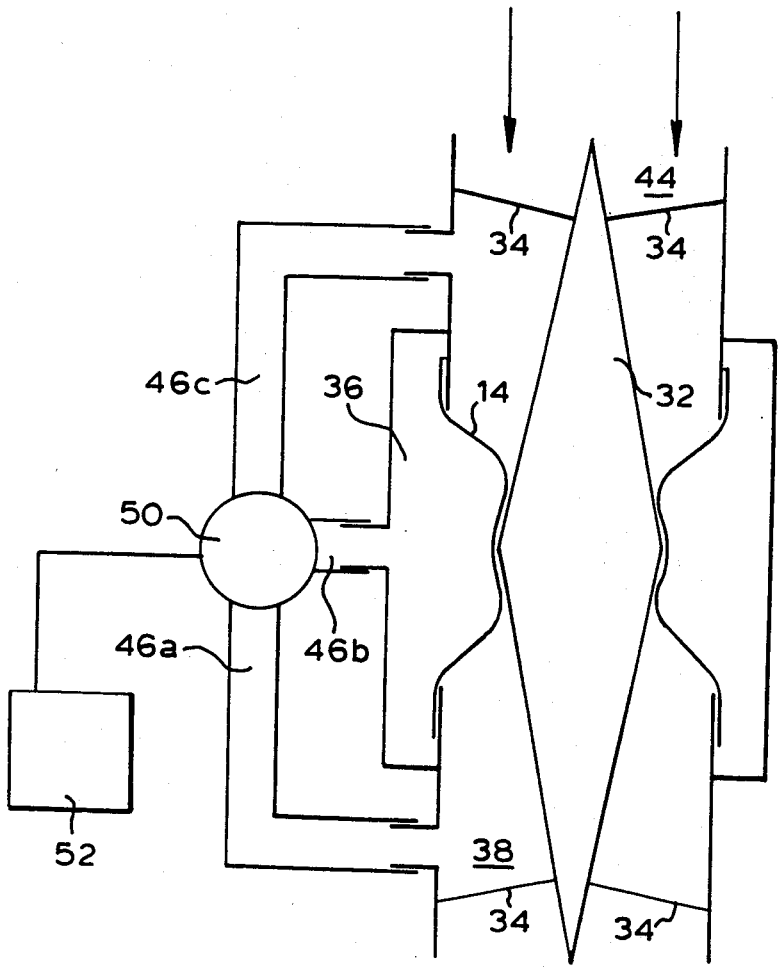
FIG. 3 is a schematic representation of a third form of valve according to the present invention.

In another embodiment which is shown in FIG. 3, both the control valves 40 and 42 are replaced by a single change-over control valve 50 arranged at the junction of the pneumatic circuit channels 46*a*, 46*b* and 46*c*. This control valve 50 can be operated to connect the manifold side 38 of the valve to the chamber 36, via channels 46*a* and 46*b*, or to connect the air filter side 44 of the valve to the chamber 36, via channels 46*b* and 46*c*. In this way, the pressure in the chamber 36 can be controlled by either connecting the chamber to manifold vacuum through passages 46*a* and 46*b*, or by connecting the chamber to ambient pressure through passages 46*b* and 46*c*.

The advantage of this system is a greater speed of response for a smaller diameter passage and valve, than is possible with the embodiment shown in FIG. 2 where the passage through the solenoid valve 40, 42 must be much bigger than the passage through the passage 46 to obtain a satisfactory speed of response.

To control this pressure accurately, the position of the control valve must be carefully modulated. This can be done by means of a solenoid control 52.

In this embodiment, the passages 46*a* and 46*c* are not used as a bypass. Instead, the valve operation is accurately controlled by controlling the pressure in the chamber 36 so that an end or "valve closed" position is reached before the flexible wall 14 seals against the core 32. A minimum through flow for engine idling purposes is then established between the core and the flexible wall.

Under some engine management schemes, it may be desirable to override this end position and to move to a fully closed position where this is no flow at all through the valve. The control circuitry for the solenoid control 52 can be arranged so as to permit this.

A valve as described can be easily incorporated in a microprocessor controlled engine system, with the solenoid valve or valves being electronically controlled, in contrast with the cable-operated butterfly valves currently in use.

Accurate flow control and fast response times can be achieved with this valve. The valve is cheap to construct and can withstand under-bonnet conditions. Because the valve is cheap and simple, one of the valves could be provided for each cylinder of an engine, and individual control of the valves could lead to improved fuel economy.

I claim:

1. A throttle valve assembly for controlling the flow of an air/fuel mixture through a carburetor of a motor vehicle, the assembly including an air/fuel flow path having a core positioned centrally therein, the flow path being defined by a tube valve having a flexible wall separating the flow path from a working fluid chamber surrounding the flexible wall, whereby changes in the pressure within the chamber cause deformation of the flexible wall resulting in changes in the tube cross-section between a wide open throttle valve position and a valve closed position, characterized in that the flexible wall collapses to a valve closed position in a free state when the pressures on opposite sides of the wall are equal, and means in the valve closed position providing a minimum fluid flow through the flow path from one side of the valve to the other side, the flexible wall sealing against the core in the valve closed position, an external bypass passage connected to the flow path from one side of the valve to the other through which passes the minimum fluid flow volume, and means interconnecting the external passage and working fluid chamber so that the chamber can be connected to the fluid pressure on either side of the tube valve, and a control valve for controlling flow through the bypass passage.

2. A valve assembly as claimed in claim 1, wherein the control valve is positioned in the external passage axially between the working chamber end the downstream end of the flow path.

3. A valve assembly as claimed in claims 1 or 2, including a second control valve positioned in the bypass passage axially between the working chamber and the upstream end of the through flow path.

4. A valve assembly as claimed in claim 3, wherein the first mentioned control valve is normally open, and the second control valve is normally closed.

5. A throttle valve assembly for controlling the flow of an air/fuel mixture through a carburetor of a motor vehicle, the assembly including an air/fuel flow path having a core positioned centrally therein, the flow path being defined by a tube valve having a flexible wall separating the flow path from a working fluid chamber surrounding the flexible wall, whereby changes in the pressure within the chamber cause deformation of the flexible wall resulting in changes in the tube cross-section between a wide open throttle valve position and a valve closed position, characterized in that the flexible wall collapses to a valve closed position in a free state when the pressures on opposite sides of the wall are equal, and means in the valve closed position providing a minimum fluid flow through the flow path from one side of the valve to the other side, and tube valve closure control means for controlling the movement of the flexible wall in a tube valve closing direction, the control means normally limiting the wall movement at a predetermined position before the wall seals against the valve core to maintain a minimum fluid flow position, for minimum flow at all times from one side of the tube valve to the other, between the core and the flexible wall.

6. A valve assembly as claimed in claim 5, including overriding means to close the tube valve completely.

7. A valve assembly as claimed in claims 5 or 6, including an external bypass passage extending from one side of the valve to the other and communicating with the working fluid chamber, and a change-over control valve is in the external passage at the point where the external passage communicates with the chamber, the control valve having a first position permitting communication between the chamber and the downstream side of the tube valve and a second position permitting communication between the chamber and the upstream side of the tube valve.

8. A valve assembly as claimed in claim 7, wherein the change-over control valve is biased toward its second position.

9. A valve assembly as claimed in claim 7, including means for modulating the setting of the change-over control valve to control the pressure in the working chamber.

10. A throttle valve assembly for controlling the flow of an air/fuel mixture through a carburetor of a motor vehicle, the assembly including an air/fuel flow path having a core positioned centrally therein, the flow path being defined by a tube valve having a flexible wall separating the flow path from a working fluid chamber surrounding the flexible wall, whereby changes in the pressure within the chamber cause deformation of the flexible wall resulting in changes in the tube cross-section between a wide open throttle valve position and a valve closed position, characterized in that the flexible wall collapses to a valve closed position in a free state when the pressures on opposite sides of the wall are equal, and means in the valve closed position providing a minimum fluid flow through the flow path from one side of the valve to the other side, the tube defining the fluid flow path having a rigid tubular inlet pipe and a rigid tubular outlet pipe and the flexible wall comprising a flexible elastic tube extending between the inlet and outlet pipes, the tube having a substantially constant cross-section in its free state smaller in diameter than the diameters of the inlet and outlet pipes to provide an interference fit therebetween upon assembly.

* * * * *